United States Patent [19]

Webster, III

[11] 4,204,895

[45] May 27, 1980

[54] GREEN FLARE COMPOSITIONS

[75] Inventor: Henry A. Webster, III, Ellettsville, Ind.

[73] Assignee: The United States of America as represented by the Secretary of the Navy, Washington, D.C.

[21] Appl. No.: 934,659

[22] Filed: Aug. 17, 1978

[51] Int. Cl.[2] ..... C06G 45/10

[52] U.S. Cl. ..... 149/19.6; 149/20; 149/22; 149/116

[58] Field of Search ..... 149/19.6, 20, 22, 116, 149/117, 61

[56] References Cited

U.S. PATENT DOCUMENTS

| | | | |
|---|---|---|---|
| 2,968,542 | 1/1961 | Brock | 149/19.6 |
| 3,467,558 | 9/1969 | Wernette et al. | 149/19.6 |
| 3,490,967 | 1/1970 | Rhodes et al. | 149/19.6 |
| 3,690,972 | 9/1972 | Kaye et al. | 149/22 |
| 3,698,968 | 10/1972 | Johnson et al. | 149/19.6 |
| 3,706,611 | 12/1972 | Hastings | 149/22 |
| 3,954,529 | 5/1976 | Reed et al. | 149/19.6 |

FOREIGN PATENT DOCUMENTS

| | | | |
|---|---|---|---|
| 1520601 | 8/1978 | United Kingdom | 149/117 |

*Primary Examiner*—Edward A. Miller
*Attorney, Agent, or Firm*—R. S. Sciascia; Paul S. Collignon

[57] ABSTRACT

Improved green flare compositions which retain acceptable dominant wavelength and purity and produce efficiencies up to about 11,000 cd-s/g. The flare compositions contain magnesium, barium nitrate, boron and a binder.

2 Claims, No Drawings

GREEN FLARE COMPOSITIONS

BACKGROUND OF THE INVENTION

The production of a good green colored signal has long been the nemesis of the pyrotechnician, particularly if a good green signal is defined as one with not only good color but also one that has a large luminous efficiency.

One standard Navy green flare has a typical output of dominant wavelength of 562 nm, an excitation purity of 53 percent of luminous power of 20,000 cd, a burn time of about 29 seconds, and a luminous efficiency of 4300 cd-s/g. The standard Navy green flare is composed of magnesium, potassium perchlorate, barium nitrate, a chlorine donor, such as polyvinyl chloride, other color additives, such as copper, and a binder. Various attempts have been made to improve on the standard Navy green flare and, heretofore, flares with better color can be obtained only with a large loss in luminous efficiency.

The magnitude of the problem of making a good green flare is illustrated in work performed under an Air Force contract by the Thiokol Chemical Corporation, and reported in Technical Report AFATL-TR-73-199, dated September 1973. This report states that, > " . . . a green smoke was obtained using small scale mixes in the laboratory, but scaled-up versions of these compositions when burned outdoors rapidly faded to white or bluish white clouds. A green flame, along with a green smoke, was never obtained with any of the test compositions."

This report further stated,

> "The addition of barium perchlorate to the cobalt composition generally produced poorer quality smoke than potassium perchlorate. A green flame was not obtained in any of the cobalt compositions even when the amount of barium perchlorate was increased to 45 percent and the binder eliminated. The additon of copper to the compositions had no effect upon flame color which was not unexpected since the green flame from both the copper and barium halide flames are easily masked by other emitters in the flame. The addition of triethyl borate to the cobalt compositions, either alone or with the chlorinated polyester binder, resulted in orange-colored flames when the samples were burned in long grains. The high temperature of the sustained combustion zone apparently decomposed the oxyalkyl radicals which normally combine with the boron from the green emitting species."

SUMMARY OF THE INVENTION

The present invention relates to an improved green flare composition which is comprised of between 25 and 40 percent of magnesium, between 5 and 15 percent of boron, between 40 and 55 percent of barium nitrate, and about 5 percent of a binder. If desired, from 5–10 percent of the fuel can be replaced with hexachlorobenzene which modification tends to increase the burn time while lowering the luminous output with a resulting small loss in efficiency.

It is therefore a general object of the present invention to provide a green flare composition which will, upon burning, produce a good green flame and produce increase efficiencies.

Other objects and advantages of the present invention will be readily appreciated as the same becomes better understood by reference to the following detailed description.

DESCRIPTION OF THE PREFERRED EMBODIMENTS

The green flare compositions of the present invention are comprised essentially of between 25 and 40 percent of magnesium, between 5 and 15 percent of boron, between 40 and 55 percent of barium nitrate and about 5 percent of an epoxy binder. By way of example, the epoxy binder might be obtained from Dow Chemical Co. and consists of about 80 percent of Dow epoxy resin CX 7069.7 and about 20 percent of a polyamine CX 3482.1.

Test flares were made using various proportions of magnesium, boron and barium nitrate and, after mixing, the compositions were pressed in fishpaper tubes and then burned. The colors observed during the flare burns were green to greenish-white. In these test flares, the primary emission is from the boric acid fluctuation bands system, $BO_2$, with maxima at 452 nm, 471 nm, 493 nm, 518 nm, 545 nm, and 580 nm. These bands are overlapped by the BaO/BaOH system. The increased efficiency of the test flare was probably a result of boron oxides being a good emitter.

The following examples will illustrate the preferred embodiments of the invention wherein parts and percentages are by weight unless otherwise specified.

EXAMPLE I

| | PERCENT |
|---|---|
| Magnesium | 40 |
| Boron | 15 |
| Barium nitrate | 40 |
| Epoxy binder | 5 |

The epoxy binder was a mixture of 80 percent of Dow epoxy resin, CX7069.7 and 20 percent of a polyamine, CX3482.1. After mixing the ingredients, the composition was pressed into a fishpaper tube using a pressure of 8000 psi. The tube had been previously coated twenty-four hours prior to pressing with the epoxy binder mixture. 150 grams of composition was used and the finished candle had a diameter of 4.4 cm and a length of 5.5 cm.

The candle was burned face-down at a distance of 1000 cm from a radiometer and 400 cm from a spectrograph. The candle was burned with the following results:

| | PERCENT |
|---|---|
| Burning time, secs | 20 |
| Candlepower (cd) | 47,800 |
| Efficiency (cd-s/g) | 6,373 |
| Dominant wavelength | 553 |
| Purity | 58 |

EXAMPLE 2

| | |
|---|---|
| Magnesium | 33 |
| Boron | 12 |
| Barium nitrate | 50 |
| Epoxy binder | 5 |

A 150 gram candle was blended and made as in EXAMPLE I and the candle was burned with the following results:

| | |
|---|---|
| Burning time, secs | 19 |
| Candlepower (cd) | 59,900 |
| Efficiency (cd-s/g | 7,587 |
| Dominant wavelength | 554 |
| Purity | 47 |

EXAMPLE 3

| | |
|---|---|
| Magnesium | 25 |
| Boron | 15 |
| Barium nitrate | 55 |
| Epoxy binder | 5 |

A 150 gram candle was blended and made as an EXAMPLE I and the candle was burned with the following results:

| | PERCENT |
|---|---|
| Burning time, secs | 19 |
| Candlepower (cd) | 59,500 |
| Efficiency (cd-s/g) | 7,537 |
| Dominant wavelength | 554 |
| Purity | 47 |

EXAMPLE 4

| | |
|---|---|
| Magnesium | 35 |
| Boron | 5 |
| Barium nitrate | 55 |
| Epoxy binder | 5 |

A 150 gram candle was blended and made as in EXAMPLE I and the candle was burned with the following results:

| | |
|---|---|
| Burning time, secs | 23 |
| Candlepower (cd) | 63,400 |
| Efficiency (cd-s/g) | 9,721 |
| Dominant wavelength | 552 |
| Purity | 53 |

EXAMPLE 5

| | |
|---|---|
| Magnesium | 39 |
| Boron | 6 |
| Barium nitrate | 50 |
| Epoxy binder | 5 |

A 150 gram candle was blended and made as in EXAMPLE I and the candle was burned with the following results:

| | PERCENT |
|---|---|
| Burning time, secs | 23 |
| Candlepower (cd) | 71,700 |
| Efficiency (cd-s/g) | 10,994 |
| Dominant wavelength | 554 |
| Purity | 52 |

EXAMPLE 6

| | |
|---|---|
| Magnesium | 30 |
| Boron | 10 |
| Barium nitrate | 50 |
| Hexachlorobenzene | 5 |
| Epoxy binder | 5 |

A 150 gram candle was blended and made as in EXAMPLE I and the candle was burned with the following results:

| | |
|---|---|
| Burning time, secs | 23 |
| Candlepower (cd) | 44,600 |
| Efficiency (cd-s/g) | 6,839 |
| Dominant wavelength | 555 |
| Purity | 55 |

EXAMPLE 7

| | PERCENT |
|---|---|
| Magnesium | 25 |
| Boron | 10 |
| Barium nitrate | 50 |
| Hexachlorobenzene | 10 |
| Epozy binder | 5 |

A 150 gram candle was blended and made as in EXAMPLE I and the candle was burned with the following results:

| | |
|---|---|
| Burning time, secs | 26 |
| Candlepower (cd) | 25,700 |
| Efficiency (cd-s/g) | 4,455 |
| Dominant wavelength | 554 |
| Purity | 60 |

EXAMPLE 8

| | |
|---|---|
| Magnesium | 40 |
| Boron | 10 |
| Barium nitrate | 40 |
| Hexachlorobenzene | 5 |
| Epoxy binder | 5 |

A 150 gram candle was blended and made as in EXAMPLE I and the candle was burned with the following results:

| | PERCENT |
|---|---|
| Burning time, secs | 29 |
| Candlepower (cd) | 29,000 |
| Efficiency (cd-s/g) | 5,607 |
| Dominant wavelength | 554 |
| Purity | 60 |

The presently used Navy standard green flare as the following composition:

| | |
|---|---|
| Magnesium | 21 |
| Barium nitrate | 22.5 |
| Potassium perchlorate | 32.5 |
| Copper | 7 |
| Polyvinyl Chloride | 12 |

-continued

| | |
|---|---|
| Epoxy binder | 5 |

A Navy standard flare was burned with the following results:

| | |
|---|---|
| Burning time, secs | 42 |
| Candlepower (cd) | 12,200 |
| Efficiency (cd-s/g) | 3,416 |
| Dominant wavelength | 562 |
| Purity | 58 |

It can be seen that the flares of the present invention which are given in EXAMPLES I to 8, all had higher efficiencies than that of the Navy standard flares and also the flares of the present invention all had higher candlepower.

A source of chlorine (hexachlorobenzene) was added to the flares listed in EXAMPLES 6, 7, and 8 above, and the emission of these flares is a result of BaCl, BaO, BaOH and BO. The purity of those flares which contained a source of chlorine was better than the other flares which were tested, however, when compared with the Navy standard green flare, all of the tested flares had a shorter dominant wavelength which made the burning flares appear less yellow.

Obviously many modifications and variations of the present invention are possible in the light of the above teachings. It is therefore to be understood that the invention may be practiced otherwise than as specifically described.

I claim:

1. A green flare composition free of chlorine containing compounds consisting essentially, by weight of between 25 and 40 percent of magnesium, between 5 and 15 percent of boron, between 40 and 55 percent of barium nitrate, and about 5 percent of an epoxy binder.

2. A green flare composition free of chlorine containing compounds which, upon burning provides a high luminous efficiency and high luminous power, consisting essentially, by weight, of about 39 percent of magnesium, about 6 percent of boron, about 50 percent of barium nitrate, about 4 percent of an epoxy resin and about 1 percent of a polyamine.

* * * * *